F8958 OR 4,690,814

United States Patent [19]

Velenyi et al.

[11] Patent Number: 4,690,814

[45] Date of Patent: Sep. 1, 1987

[54] PROCESS FOR THE PRODUCTION OF HYDROGEN

[75] Inventors: Louis J. Velenyi, Lyndhurst; Andrew S. Krupa, Twinsburg, both of Ohio

[73] Assignee: The Standard Oil Company, Cleveland, Ohio

[21] Appl. No.: 849,925

[22] Filed: Apr. 9, 1986

Related U.S. Application Data

[62] Division of Ser. No. 692,157, Jun. 17, 1985, abandoned.

[51] Int. Cl.[4] ..... C01B 31/18

[52] U.S. Cl. ..... 423/648 R; 252/373; 423/415 A

[58] Field of Search ..... 423/648 R, 415 A; 252/373

[56] References Cited

U.S. PATENT DOCUMENTS

| | | | |
|---|---|---|---|
| 1,677,758 | 7/1928 | Frank | 423/648 R |
| 2,416,003 | 2/1947 | Guyer | 423/648 R |
| 2,592,377 | 8/1952 | Barr et al. | 423/415 A |
| 2,614,038 | 10/1952 | Barr | 423/648 R |
| 3,304,249 | 2/1967 | Katz | 204/164 |
| 4,069,304 | 1/1978 | Starkovich et al. | 423/648 R |
| 4,128,473 | 12/1978 | Karr et al. | 423/648 R |

FOREIGN PATENT DOCUMENTS

| | | | |
|---|---|---|---|
| 1246688 | 8/1967 | Fed. Rep. of Germany | 423/648 R |
| 1010574 | 11/1965 | United Kingdom | 423/648 R |

*Primary Examiner*—John Doll
*Assistant Examiner*—Wayne A. Langel
*Attorney, Agent, or Firm*—Larry W. Evans; David J. Untener; Raymond F. Keller

[57] ABSTRACT

In a process for the production of hydrogen by the reaction of steam with carbon, a catalyst system is employed comprising a supported Group VIIIA metal and, as modifier for the suppression of methane, an effective amount of an oxide of molybdenum or tungsten.

17 Claims, No Drawings

T 423/657
X 423/658

PROCESS FOR THE PRODUCTION OF HYDROGEN

This is a division of application Ser. No. 692,157 filed Jan. 17, 1985, abandoned.

BACKGROUND OF THE INVENTION

1. Field of the Invention

This invention relates to a novel catalyst system suitable for use in the production of hydrogen by the reaction of steam with carbon, to a process for the preparation of the catalyst system and to a process for the production of hydrogen by the reaction of steam with carbon employing said novel catalyst system.

2. Description of Art

The reaction of steam with carbon to form hydrogen has been previously described and sometimes constitutes the second stage of a two-stage process previously described for the preparation of hydrogen. In this process, carbon is formed in a first stage by, for example, decomposition of carbon monoxide in the presence of a catalyst. The carbon is then reacted with steam in a second stage in the presence of the same catalyst to form hydrogen in admixture with carbon dioxide and carbon monoxide. It is a feature of this stage that some of the hydrogen which is formed is lost by reaction with the carbon to form methane. Besides the loss of valuable product, there is also the problem of separating the methane from the hydrogen.

It is therefore an object of the present invention to reduce the amount of methane formed in the reaction of the steam and carbon.

SUMMARY OF THE INVENTION

According to one aspect of the present invention, a catalyst system suitable for use in the production of hydrogen by reaction of steam with carbon comprises a Group VIIIA metal on a support and, as modifier for the suppression of methane, an effective amount of an oxide of a Group VIA metal selected from the group consisting of tungsten and molybdenum.

According to another aspect of the present invention, a process for the preparation of a catalyst system suitable for use in the production of hydrogen by the reaction of steam with carbon comprises incorporating as a suppressant for the formation of methane an oxide of a Group VIA metal selected from the group consisting of molybdenum and tungsten into a supported Group VIIIA metal catalyst.

According to a further aspect of the present invention, a process for the production of hydrogen comprises reacting steam with carbon in the presence of a catalyst system comprising a supported Group VIIIA metal catalyst and, as modifier for the suppression of methane, an effective amount of an oxide of a metal of Group VIA selected from the group consisting of molybdenum and tungsten.

The form of the Periodic Table employed in the present specification is that published by Sargent-Welch Scientific Company of Skokie, Ill. in 1979 in which the rare gases comprise Group VIII.

DETAILED DESCRIPTION OF THE INVENTION

The amount of oxide modifier present in the catalyst system can be such as to provide from 1 to 20 percent, preferably 3 to 15 percent, by weight of metal (tungsten or molybdenum) based on the total weight of the catalyst system, i.e., Group VIIIA metal catalyst, support and modifier.

The term oxide of tungsten or molybdenum as used herein means not only compounds such as $MoO_3$, but also species in which the metal is combined with oxygen in an anion such as a molybdate or tungstate.

The molybdate or tungstate can also contain phosphorus, for example, as a phosphomolybdate or phosphotungstate.

Further, the term molybdate as used herein means molybdates, polyoxymolybdates, including those formed from molybdic acids, oxides and acid anhydrides of the formulae: $MoO_3.xH_2O$, $H_2MoO_4$, $H_2Mo_2O_7$, $H_2Mo_3O_{10}$, $H_6Mo_7O_{24}$, $H_4Mo_8O_{26}$ and the like. The term tungstate has a corresponding meaning.

The modifier can be a compound of the formula $H_3PW_{12}O_{40}$ or $H_3PMo_{12}O_{40}$ or a salt of either of these acids with a metal or ammonium cation. The metal cation can be any from Groups IA, IIA, IB, IIB, IVA, VA of the Periodic Table or any of the following metals: Mn, Re, Tl, Sn, Pb, Bi, Ce or Th.

The Group VIIIA metal catalyst can be any of those known for use in the reaction of steam with elemental carbon to form hydrogen, for example, supported nickel, cobalt or ruthenium.

The catalyst system conveniently contains from 5 to 25 percent by weight of Group VIIIA metal preferably 10 to 20 percent based on the total weight of the catalyst system.

The modifier can be incorporated in the catalyst by impregnation, for example, by contacting the supported Group VIIIA metal catalyst with a solution, conveniently an aqueous solution, of a molybdate or tungstate, preferably a phosphomolybdate or phosphotungstate. Alternatively the support can be impregnated with the modifier prior to incorporation of the Group VIIIA metal catalyst which is also preferably incorporated by impregnation, for example, by nickel nitrate. As a third alternative the support can be impregnated with a solution containing both the Group VIIIA metal and the modifier so that both components impregnate the support simultaneously.

After impregnation the solids are calcined to remove volatile and thermally decomposable components. The effect of the calcination may in certain cases decompose a molybdate or tungstate, for example, a molybdate to an oxide of formula $MoO_3$, but this does not happen in all cases. Conveniently the calcined solids are then subjected to a reduction treatment by heating in a stream of a reducing gas, e.g., hydrogen. The reduction treatment is however not essential.

Examples of support materials are silica, alumina, silica/alumina, zirconia, titania, hafnia, silicon carbide, boron phosphate, diatomaceous earth, pumice and the like. Preferably the support material has a surface area of greater than 1 to less than about 400 $m^2/gm$, a pore volume of about 0.4 to about 3 cc/gram and contains no measurable pores of diameter less than 50 angstroms. Preferred are those supports having a surface area of about 6 to about 250 $m^2/gm$ and pore volumes of about 0.8 to about 2 cc/gm. Most preferred are supports having a surface area of about 30 to about 80 $m^2/gm$ and a pore volume of about 0.8 to about 2 cc/gm.

Especially preferred support materials are those as described above which are further characterized as containing no measurable pores having pore diameters of less than 70 angstroms when measured by the mercury porosimeter technique.

The surface areas referred to in the present specification were determined by the well-known B.E.T. method employing nitrogen adsorption. The pore diameters were determined by the mercury porosimeter technique using a Quantachrome Autoscan −60(33) porosimeter.

In accordance with this technique, which is described in H. M. Rootare and C. F. Prenzlow, *Surface Area from Mercury Porosimeter Measurements,* Journal of Physical Chemistry, 71, 2733 (1967), a mixture of mercury and the porous material to be tested is subjected to increasing pressure whereby mercury is forced into the pores of the material. A decrease in volume of the mixture corresponds to the amount of mercury taken up by the pores of the material. As the diameter of the pores decreases, greater pressure is needed to force mercury into the pores, and this relationship (pressure versus pore diameter) is known. Thus measurement of the pressure at any one point of time as the mixture is being subjected to increasing pressure indicates the diameter of the pores being filled with mercury at that point in time. In accordance with the preferred embodiment of the invention, porous support particles are used which show no measurable pores having a pore diameter of less than 50 angstroms, preferably 70 and more preferably 100 angstroms. This is reflected by the fact that once the pressure corresponding to 50 (or 70 or 100) angstroms is reached, there is no more volume decrease and hence no more uptake of mercury by the pores of the support even if the pressure is further increased. This does not mean that the particles contain no pores having a pore diameter of 50 angstroms or less, but rather just that the mercury porosimeter technique is unable to measure the presence of such pores.

The catalyst system prepared as described above can then be used for the production of hydrogen by the reaction of steam with carbon.

The conditions for this reaction can suitably be as follows:

Temperature: from 400° C. to 950° C. preferably 500° to 750° C.

Pressure: Up to 500 psig preferably from 0.5 to 5.0 atmospheres.

Space Velocity of Steam: 500 to 20,000 GHSV preferably from 1000 to 5000 GHSV.

Preferably the catalyst particles are operated as a fluidized bed by the action of the gases (steam and optionally diluent gases) passing there through.

SPECIFIC EMBODIMENTS

The invention is illustrated by the following examples and comparative experiments.

EXAMPLE 1

Preparation of Catalyst System (a) Hydrothermal treatment of silica

The purpose of the following hydrothermal treatment is to decrease the surface area and increase the pore size of the silica.

Commercially available $SiO_2$ (80.0 grams) sold by Akzo Chemie under the trade designation F-5, was mixed in an autoclave with a solution of 0.56 grams of $K_2CO_3$ and 200 ml of distilled water. The autoclave was brought to 230° C. and maintained at that temperature for 30 minutes at 400 psig. After 30 minutes, the autoclave was rapidly cooled by flushing water through a loop within the autoclave and bringing the pressure down to atmospheric within 2 minutes. The silica was then removed from the reactor, washed 3 times with 100 ml aliquots of distilled water and then dried overnight in air at 110° C.

The silica treated by the above-described hydrothermal treatment had the following properties:

(i) a surface area of 65 $m^2$/gm (671 $m^2$/gm), (ii) a pore volume of 1.36 cc/gm (0.84 cc/gm).

Figures in brackets were the values before hydrothermal treatment.

(iii) no pores of less than 70 angstroms in diameter whereas pores of 36 angstroms were detected before treatment.

(b) Impregnation of the hydrothermally treated silica support.

4.38 g of the salt $Na_3PW_{12}O_{40}$ (95 percent purity) were dissolved in 20 g of water and the solution added dropwise with stirring to 23.4 g of the hydrothermally treated silica support which was then dried at 150° C. for 4 hours.

23.2 g of $Ni(NO_3)_2.6H_2O$ were dissolved in 20 g of water and added dropwise with stirring to the tungsten impregnated support which was then dried overnight. The product was then calcined at 400° C. in air for 6 hours, and the calcined material heated to 550° C. for 90 minutes in a stream of hydrogen (130 cc/min) and further at 650° C. for a period of 30 minutes.

The thus prepared catalyst system contained 15 percent by weight of nickel and 10 percent by weight of tungsten both percents being based on the total weight of support, catalyst and modifier.

EXAMPLES 2 TO 14

The impregnation procedure described in step (b) of Example 1 was repeated for different modifiers and the preparations are summarized below and in the following Table 1.

In the following examples the silica support was impregnated with the solutions described in the order stated as follows:

Example 2:
- (1) phosphotungstic acid (3.1 g in 20 g water)
- (2) potassium nitrate (0.31 g in 28 g water)
- (3) nickel nitrate (17.0 g in 21 g water)

Example 3:
- (1) sodium tungstate (6.7 g in 25 g water)
- (2) nickel nitrate (27.6 g in 25 g water)

Example 4:
- (1) phosphotungstic acid (2.6 g in 21 g water)
- (2) nickel nitrate (13.7 g in 15 g water)

Example 5:
- (1) phosphotungstic acid (3.6 g) and magnesium nitrate (0.62 g) together in 23 g water then (2) nickel nitrate (3.9 g in 21 g water)

Example 6:
- (1) sodium phosphotungstate (4.8 g) and strontium nitrate (3.9 g) together in 30 g water then (2) nickel nitrate (24.1 g in 19 g water)

Example 7:
- (1) phosphotungstic acid (3.1 g) and cerium nitrate (1.4 g) together in 20 g water then (2) nickel nitrate (16.8 g in 20 g water)

Example 8:
- (1) phosphotungstic acid (3.4 g in 24 g water)
- (2) cesium nitrate (0.65 g in 20 g water)
- (3) nickel nitrate (15.3 g in 19 g water)

Example 9:
(1) phosphotungstic acid (4.2 g in 25 g water)
(2) sodium nitrate (0.36 g in 22 g water)
(3) nickel nitrate (22.8 g in 23 g water)

Example 10:
(1) zinc nitrate (0.64 g) and phosphotungstic acid (4.3 g) together in 27 g water then (2) nickel nitrate (24 g in 23 g water)

Example 11: nickel nitrate (29.6 g) and ammonium tungstate (6.1 g) in 28 g water Example 12:
(1) sodium phosphotungstate (1.2 g in 30 g water)
(2) nickel nitrate (21.5 g in 20 g water)

Example 13:
(1) nickel nitrate (47.5 g in 25 g water) impregnated 52 g of silica.
(2) 15.7 g of the thus impregnated silica were then impregnated with sodium phosphotungstate (2.4 g in 19 g water)

Example 14: 14.7 g of the impregnated silica from step (1) of Example 13 were impregnated with phosphotungstic acid (2.2. g in 24 g water)

TABLE 1

| Example No. | Modifier | Weight of Silica (g) | Finished Catalyst System* |
|---|---|---|---|
| 2 | $K_3PW_{12}O_{40}$ | 17.1 | 10% W, 15% Ni |
| 3 | $Na_2WO_4$ | 27.8 | " |
| 4 | $H_3PW_{12}O_{40}$ | 14.5 | " |
| 5 | $Mg_{1.5}PW_{12}O_{40}$ | 19.5 | " |
| 6 | $Na_3PW_{12}O_{40}$ and 5% Sr | 22.7 | 10% W, 15% Ni, + 5% Sr |
| 7 | $CePW_{12}O_{40}$ | 17.0 | 10% W, 15% Ni |
| 8 | $CsPW_{12}O_{40}$ | 18.5 | " |
| 9 | $Na_3PW_{12}O_{40}$ | 23.0 | " |
| 10 | $Zn_{1.5}PW_{12}O_{40}$ | 23.6 | " |

TABLE 1-continued

| Example No. | Modifier | Weight of Silica (g) | Finished Catalyst System* |
|---|---|---|---|
| 11 | $(NH_4)_2WO_4$ | 33.9 | " |
| 12 | $Na_3PW_{12}O_{40}$ | 23.7 | 3% W, 15% Ni |
| 13 | $Na_3PW_{12}O_{40}$ | 15.7 | 10% W, 15% Ni |
| 14 | $H_3PW_{12}O_{40}$ | 14.7 | 10% W, 15% Ni |

*The other elements in the modifier such as sodium, potassium, cerium, zinc, etc. more not analyzed for, but can be obtained by calculation.

EXAMPLES 15 TO 26

The catalyst systems prepared as described in Examples 1 to 14 were employed first to catalyze the decomposition of carbon monoxide to form elemental carbon. This was done by heating 20 cc of the catalyst system in a one inch internal diameter quartz tube reactor (which was disposed with its axis vetical) to 450° C. and passing a feed of 46 cc/minute of hydrogen, 99 cc/minute of nitrogen and 195 cc/minute of carbon monoxide through the reactor to fluidize the catalyst particles and deposit carbon. Then the catalyst was used to catalyze the reaction of steam with the elemental carbon. This was effected by heating to 550° C. and then passing 92 cc/minute of nitrogen and 0.108 g/minute of steam through the tube to fluidize the catalyst particles. The product stream was analyzed for hydrogen and methane. The results are recorded in the following Table 2.

TABLE 2

| Example No. | Modifier | Catalyst System From Example No. | Reaction Temperature | Rate gC/hr/gNi | Ratio of moles of hydrogen to moles of Methane in Product Gas |
|---|---|---|---|---|---|
| 15 | $Na_3PW_{12}O_{40}$ | 1 | 550° C. | 0.72 | 79:1 |
| 16 | $K_3PW_{12}O_{40}$ | 2 | 550° C. | 0.68 | 314:1 |
| 17 | $Na_2WO_4$ | 3 | 550° C. | 0.64 | 98:1 |
| 18 | $H_3PW_{12}O_{40}$ | 4 | 550° C. | 0.33 | 466:1 |
| 19 | $Mg_{1.5}PW_{12}O_{40}$ | 5 | 550° C. | 0.53 | 442:1 |
| 20 | $Na_3PW_{12}O_{40}$ + 5% Sr | 6 | 550° C. | 0.87 | 46:1 |
| 21 | $CePW_{12}O_{40}$ | 7 | 550° C. | 0.37 | 29.3:0 |
| 22 | $Cs_3PW_{12}O_{40}$ | 8 | 550° C. | 0.68 | 119:1' |
| 23 | $Na_3PW_{12}O_{40}$ | 9 | 550° C. | 0.58 | 89:1 |
| 24 | $Zn_{1.5}PW_{12}O_{40}$ | 10 | 550° C. | 0.37 | 146:1 |
| 25 | $(NH_4)_2WO_4$ | 11 | 650° C. | 0.59 | 77:1 |
| 26 | $Na_3PW_{12}O_{40}$ (3% W) | 12 | 550° C. | 0.65 | 134:1 |
| 27 | $Na_3PW_{12}O_{40}$ | 13 | 550° C. | 0.81 | 132:1 |
| 28 | $H_3PW_{12}O_{40}$ | 14 | 550° C. | 0.22 | 28.6:0 |

Comparative Experiments

| Experiment | | Reaction Temperature | Rate gC/hr/gNi | Ratio of moles of hydrogen to moles of Methane in Product Gas |
|---|---|---|---|---|
| 1 | No modifier (15% Ni on silica prepared in Example 1) | 550° C. | 0.72 | 27:1 |
| 2 | No modifier (15% Ni on silica prepared in Example 1) | 550° C. | 0.70 | 32:1 |
| 3 | No modifier (15% Ni on silica prepared in Example 1) | 550° C. | 0.87 | 18:1 |

The above results demonstrate that the catalyst systems which include the modifier yield a much higher molar ratio of hydrogen to methane than those which do not include the modifier.

We claim:

1. A process for the production of hydrogen which process comprises reacting steam with carbon in the presence of a catalyst system comprising a supported Group VIIIA metal and, as modifier for the suppression of methane, an effective amount of one or more of phosphomolybdic acid, phosphotungstic acid and/or a salt of either.

2. A process for the production of hydrogen which process comprises a first stage in which carbon is formed by the thermal decomposition of a carbon-containing compound and a second stage in which steam is reacted with said carbon as claimed in claim 1.

3. The process of claim 1 wherein said catalyst system comprises nickel on a support.

4. The process of claim 1 wherein said catalyst is made by impregnating solids comprising said support with said Group VIIIA metal and one or more of phosphomolybdic acid, phosphotungstic acid and/or the salt of either simultaneously or sequentially with one or more solutions containing said Group VIIIA metal and said phosphomolybdic acid, phosphotungstic acid and/or salt of either, and calcining the impregnated solids.

5. The process of claim 4 wherein said calcination is effected at a temperature of about 250° to about 600° C.

6. The process of claim 4 wherein the calcined solids are subjected to a reduction treatment by heating in a stream of a reducing gas.

7. The process of claim 1 wherein said catalyst system further comprises a metal selected from the group consisting of an alkali metal, alkaline earth metal or lanthanide.

8. The process of claim 1 wherein said Group VIIIA metal is present in an amount from about 5 to about 25% by weight based on the total weight of catalyst and support.

9. The process of claim 1 wherein said Group VIIIA metal is present in an amount from about 10 to about 20% by weight based on the total weight of catalyst and support.

10. The process of claim 1 wherein said support for said catalyst system has a surface area of from about 1 to about 400 $m^2/gm$, a pore volume from about 0.4 to about 3 cc/gm and contains no measurable pores of diameter less than about 50 angstroms.

11. The process of claim 1 wherein said support for said catalyst system has a surface area of from about 6 to about 250 $m^2/gm$, a pore volume from about 0.8 to about 2 cc/gm and contains no measurable pores of diameter less than about 70 angstroms.

12. The process of claim 1 wherein said Group VIIIA metal is selected from the group consisting of nickel, cobalt and ruthenium.

13. The process of claim 1 wherein said catalyst system contains from about 1 to about 20% by weight of tungsten or molybdenum based on the total weight of catalyst and support.

14. The process of claim 1 wherein said catalyst system contains from about 3 to about 15% by weight of tungsten or molybdenum based on the total weight of catalyst and support.

15. The process of claim 1 wherein said steam is reacted with said carbon in the presence of said catalyst system at a temperature from about 400° to about 950° C. and a pressure up to about 500 psig.

16. The process of claim 1 wherein said steam is reacted with said carbon in the presence of said catalyst system at a temperature from about 500° to about 750° C. and a pressure from about 0.5 to about 5 atmospheres.

17. The process of claim 1 wherein said catalyst system is in the form of particles and said steam is passed through said catalyst particles, said catalyst particles forming a fluidized bed.

* * * * *